US006532606B1

(12) United States Patent
Skovronski

(10) Patent No.: US 6,532,606 B1
(45) Date of Patent: Mar. 18, 2003

(54) ADJUSTABLE PEDESTAL FOR STARTING PLATFORM FOR SWIMMING POOL

(75) Inventor: Jonathan Skovronski, Paddock Lake, WI (US)

(73) Assignee: Kiefer Pool Equipment Co., Zion, IL (US)

( * ) Notice: Subject to any disclaimer, the term of this patent is extended or adjusted under 35 U.S.C. 154(b) by 0 days.

(21) Appl. No.: 10/047,791

(22) Filed: Jan. 14, 2002

(51) Int. Cl.[7] ..... E04H 4/00

(52) U.S. Cl. ..... 4/496; 4/488; 434/254; 434/247; 472/128

(58) Field of Search ..... 4/496, 488; 434/247, 434/254; 472/128; D21/801–802

(56) References Cited

U.S. PATENT DOCUMENTS

| | | | | |
|---|---|---|---|---|
| D202,546 S | * 10/1965 | French | D21/802 |
| 3,916,214 A | * 10/1975 | Coble et al. | 307/119 |
| 4,666,147 A | * 5/1987 | Warman | 482/30 |
| 5,916,031 A | * 6/1999 | Casillan | 472/85 |
| 6,247,935 B1 | * 6/2001 | Martin et al. | 434/254 |

OTHER PUBLICATIONS

Kiefer Pool Equipment Company; Zion, Illinois; Starting Platforms– Kiefer Intrepid Starting Platform.*

Kiefer Pool Equipment Company, Zion, Illinois, "2002 Product Guide", p. 2.

* cited by examiner

*Primary Examiner*—Gregory Huson
*Assistant Examiner*—Amanda R. Flynn
(74) *Attorney, Agent, or Firm*—Wood, Phillips, Katz, Clark & Mortimer

(57) ABSTRACT

In an adjustable pedestal for a starting platform for one end of a swimming pool, two telescoping members, namely an upper, inner, tubular member and a lower, outer, tubular member, are fastened releasably to each other so as to define a generally upright column of an adjustable length. An upper step is mounted to an upper bracket and a lower step is mounted to a lower bracket. Certain bolts are used for fastening the upper and lower members releasably to each other and for mounting the upper bracket, to which the upper step is mounted, releasably to the column. Other bolts are used for mounting the lower bracket, to which the lower step is mounted, to the column. In some applications, the lower step, lower brackets, and bolts for mounting same are omitted.

9 Claims, 3 Drawing Sheets

ADJUSTABLE PEDESTAL FOR STARTING PLATFORM FOR SWIMMING POOL

TECHNICAL FIELD OF THE INVENTION

This invention pertains to a pedestal for supporting a top for a starting platform for one end of a swimming pool. Pedestals embodying this invention are adjustable so as not to require, in many instances, custom fitting, via custom cutting or welding operations, to accommodate pool dimensions, water level, and other factors from one swimming pool to another.

BACKGROUND OF THE INVENTION

In a swimming meet, each swimmer starts at a starting platform, which may be also called a starting block, at one end of a swimming pool. Typically, a starting platform comprises a base, stand, or pedestal, to which a top is mounted so that its upper surface is horizontal or so that its upper surface is sloped slightly (e.g. not more than 10° from horizontal) from the back edge of the top toward its front edge. Several models of such starting platforms are available commercially from Kiefer Pool Equipment Co. of Zion, Ill., as illustrated and described briefly on page 2 of its 2002 Product Guide, in which such starting platforms are called starting blocks.

Typically, installation of a starting block must conform to governmental and non-governmental rules, standards, and regulations. As an example, a 1991 rule of the National Federation of State High School Associations provides that, if a swimming pool has less than four feet of water at its starting end, a starting platform may be no higher than eighteen inches from the water level at the starting end. Commonly, therefore, the base, stand, or pedestal of a starting platform, as known heretofore, must be custom fitted, via custom cutting and welding operations, so as to accommodate pool dimensions, water level, and other factors from one swimming pool to another.

SUMMARY OF THE INVENTION

This invention provides, for supporting a top for a starting platform for one end of a swimming pool, an adjustable pedestal, which has an upper member and a lower member. The upper and lower members are fastened releasably to each other, as by means comprising a bolt or bolts, so as to define a generally upright column having any of a plurality of adjusted lengths. The upper member is adapted to support a top for the starting platform. The lower member is adapted for anchoring to a base. Preferably, the upper and lower members are tubular and have a telescoping relationship when not fastened to each other, the upper member extending downwardly into the lower member.

The starting platform may have a step, which is fastened releasably to the generally upright column, via a bracket, to which the step is mounted, at any of a plurality of adjustable positions. Means comprising a bolt or bolts are used for fastening the bracket, to which the step is mounted, releasably to the generally upright column. The means used for fastening the upper and lower members releasably to each other may be also used for fastening the bracket, to which the step is mounted, releasably to the generally upright column.

The pedestal may have an upper step, an upper bracket, to which the upper step is mounted, a lower step, and a lower bracket, to which the lower step is mounted. Means comprising bolts are used for fastening the upper and lower members of the generally upright column releasably to each other, for fastening the upper bracket, to which the upper step is mounted, releasably to the generally upright column, and for fastening the lower bracket, to which the lower step is mounted, to the generally upright column. The means for fastening the upper and lower members of the generally upright column to each other may be also used for fastening the upper bracket, to which the upper step is mounted, releasably to the generally upright column.

In this document, all directional terms referring to a pedestal, particularly but not exclusively "upper", "lower", and "generally upright", are intended to refer to the pedestal, as installed in its usual orientation, not to limit the pedestal, as made and sold, to any particular orientation. Moreover, the term "generally upright column" is intended to cover a sloping column, as well as a vertical column.

BRIEF DESCRIPTION OF THE DRAWINGS

FIG. 3 illustrates, in broken lines, a starting platform top, which is mounted on the pedestal, two step covers, each of which is mounted on a separate step of the pedestal, a concrete pad, to which the pedestal is anchored, and associated fasteners.

FIGS. 1, 2, 3, and 4 illustrate the pedestal when adjusted to its maximum height.

DETAILED DESCRIPTION OF THE ILLUSTRATED EMBODIMENT

Figure 3:
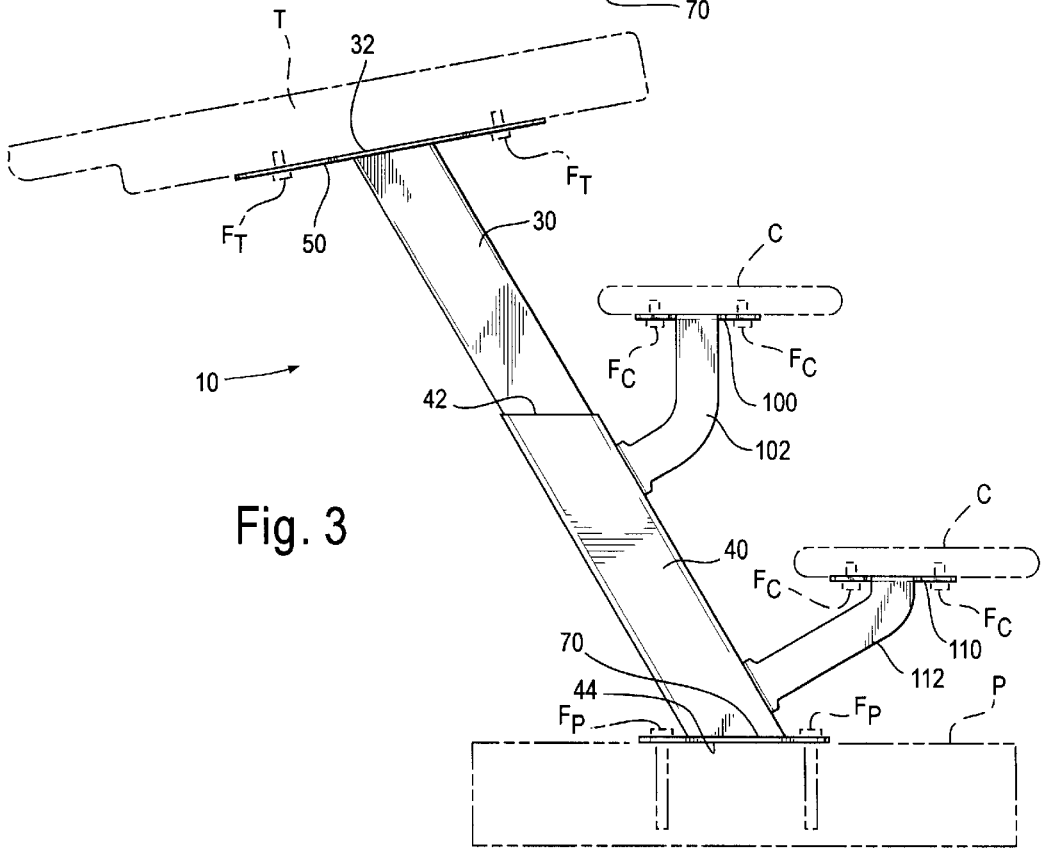
FIGS. 3 and 4 are side views of the pedestal, as taken from opposite sides thereof.

As illustrated in the drawings, a starting platform pedestal 10 made from stainless steel and embodying this invention is intended (see FIG. 3) to support a starting platform top T, which may be polymeric, via stainless steel fasteners $F_T$ and to be fixedly or removably anchored to a concrete pad P (see FIG. 3) via stainless steel fasteners $F_p$ at one end of a swimming pool. The pedestal 10 comprises a generally upright column 20, which is tilted somewhat (e.g., approximately 30° from vertical) toward the swimming pool when the pedestal 10 is anchored. The column 20 is defined by two members having a telescoping relationship with each other when not fastened to each other, i.e., an upper, inner, tubular member 30 having a generally rectangular cross-section and a lower, outer, tubular member 40 having a generally rectangular cross-section. The column 20 is adjustable, as disclosed herein, so as to have any of a plurality of adjusted lengths.

The upper member 30 has an upper end 32 and a lower end 34. An upper plate 50, which is welded to the upper end 32 of the upper member 30, supports the starting platform top 12, which is mounted to the upper plate 50 via the fasteners $F_T$, which are conventional fasteners having threaded shanks extending upwardly through unthreaded holes 52 in the upper plate 50, into conventional, stainless steel, suitably threaded, downwardly opening receptacles (not shown) embedded in the starting platform top 12. The upper end 32 is bias-cut so that the upper plate 50 and the starting platform top 12, when supported by the upper plate 50, slope slightly (e.g., approximately 10° from horizontal) toward the swimming pool when the pedestal 10 is anchored. At the lower end 34, a back wall 36 of the upper member 30 has four unthreaded holes 38 and mounts a fastening inner plate 60, which has four threaded holes 62 and which is welded to the back wall 36 so that each of the holes 62 is aligned with one of the holes 38.

The lower member 40 has an upper end 42 and a lower end 44. A lower plate 70, which is welded to the lower end 44, is anchored to the concrete pad via the fasteners $F_p$, which are conventional fasteners having threaded shanks extending downwardly through unthreaded holes 72 in the lower plate 70, into conventional, suitably threaded, upwardly opening receptacles (not shown) embedded in the concrete pad P. As an alternative, the fasteners $F_p$ can be permanently anchored, via their shanks, in the concrete pad P. The lower end 44 is bias-cut so that the generally upright column 20 is tilted somewhat, as mentioned above, toward the swimming pool when the pedestal 10 is anchored. A back wall 46 of the lower member 40 has two columns of regularly spaced, unthreaded holes 48, nine holes 48 in each column. Within the lower member, near the lower end 44, an inner plate 80, which has four threaded holes 82, is welded to the back wall 46 so that each of the holes 82 is aligned with one of the lowermost two holes 48 in each column. As should be evident from in FIG. 5, the lower end 34 of the upper member 30 would reach the fastening plate 80, which would limit the depth of insertion of the upper member 30 into the lower member 40, if the respective members 30, 40, were not fastened to each other.

Figure 4:
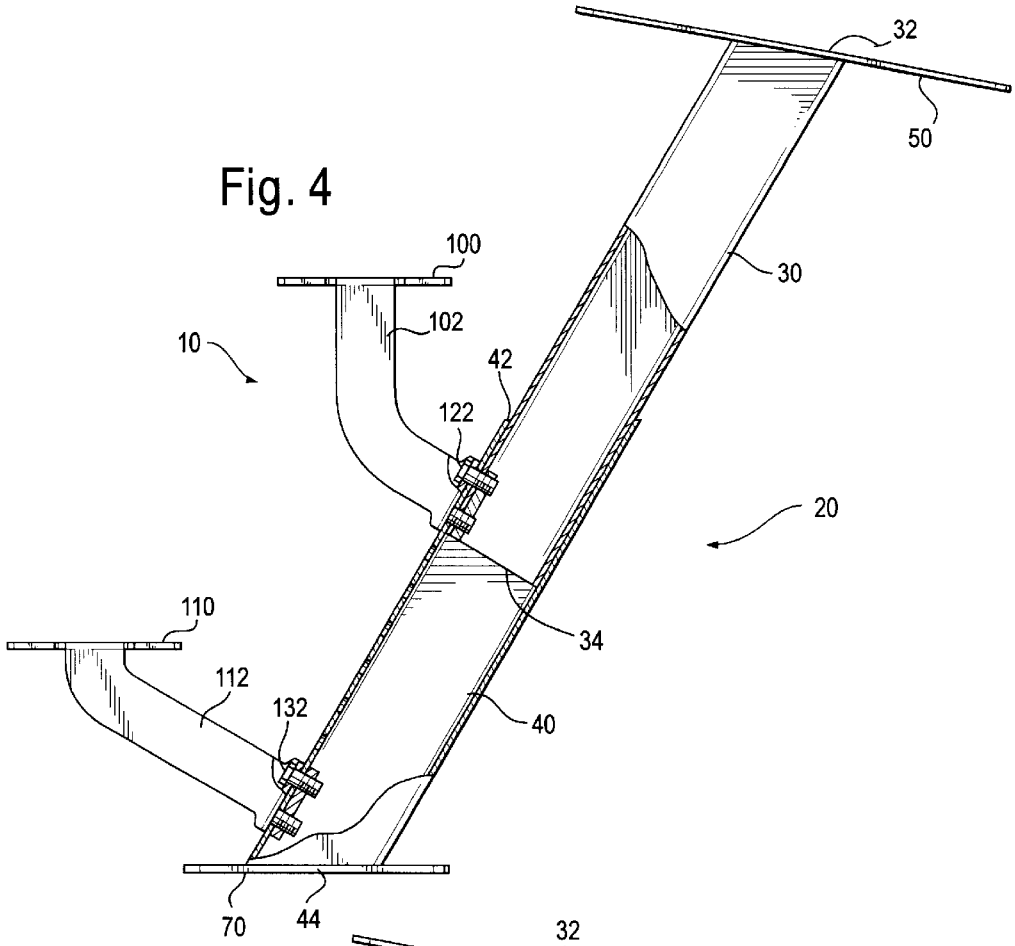
Figure 5:
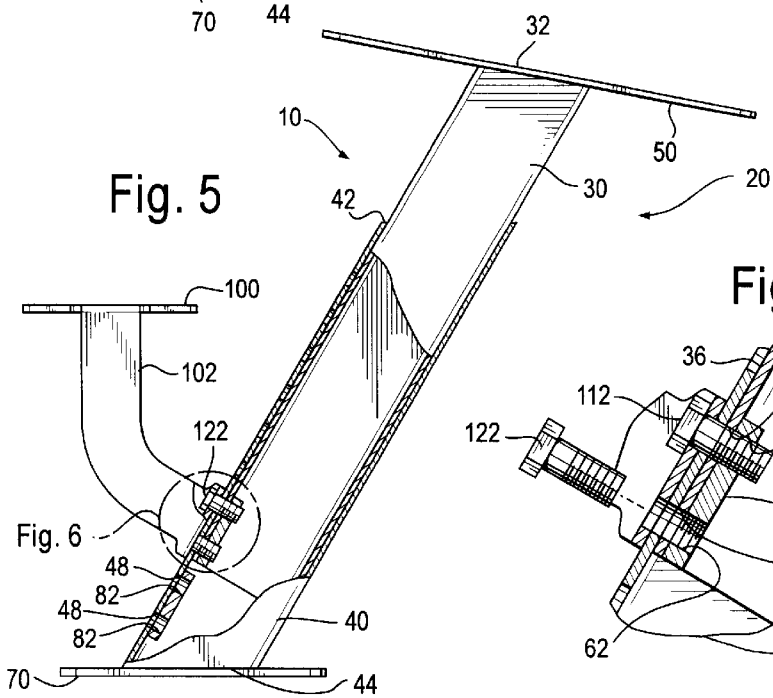
FIG. 5 is a side view, partly broken away, which is similar to FIG. 4 but which illustrates the pedestal when adjusted to its minimum height, without one of the separate steps.
Figure 6:
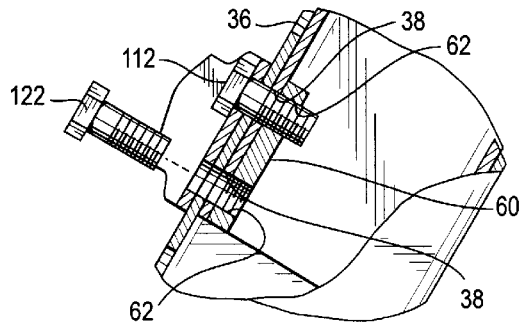
FIG. 6, on a larger scale, is a fragmentary detail, as taken from a region denoted by a broken-line circle in FIG. 5. One fastener illustrated in FIG. 6 is not illustrated in FIG. 5.

Whether the pedestal 10 is provided in a given installation with two steps, as illustrated in FIGS. 1, 2, 3, and 4, or with a single step, as illustrated in FIG. 5, depends largely upon the adjusted length of the generally upright column 20. If the pedestal 10 is provided with two steps, as illustrated in FIGS. 1, 2, 3, and 4, a step 100 mounted to a bracket 102, which appears to be comparatively taller from either side of the pedestal 10, and a step 110 mounted to a bracket 112, which appears to be comparatively shorter from either side of the pedestal 10, are mounted to the generally upright column 20 so that the step 100 and the bracket 102 are above the step 100 and the bracket 102. If the pedestal 10 is provided with a single step, as illustrated in FIG. 5, the step 100 and the bracket 102 are mounted to the generally upright column 20 and the step 110 and the bracket 112 are omitted. In any given installation of the pedestal 10, whether the pedestal 10 is provided with two or with a single step depends largely upon the adjusted length of the generally upright column 20.

Figure 1:
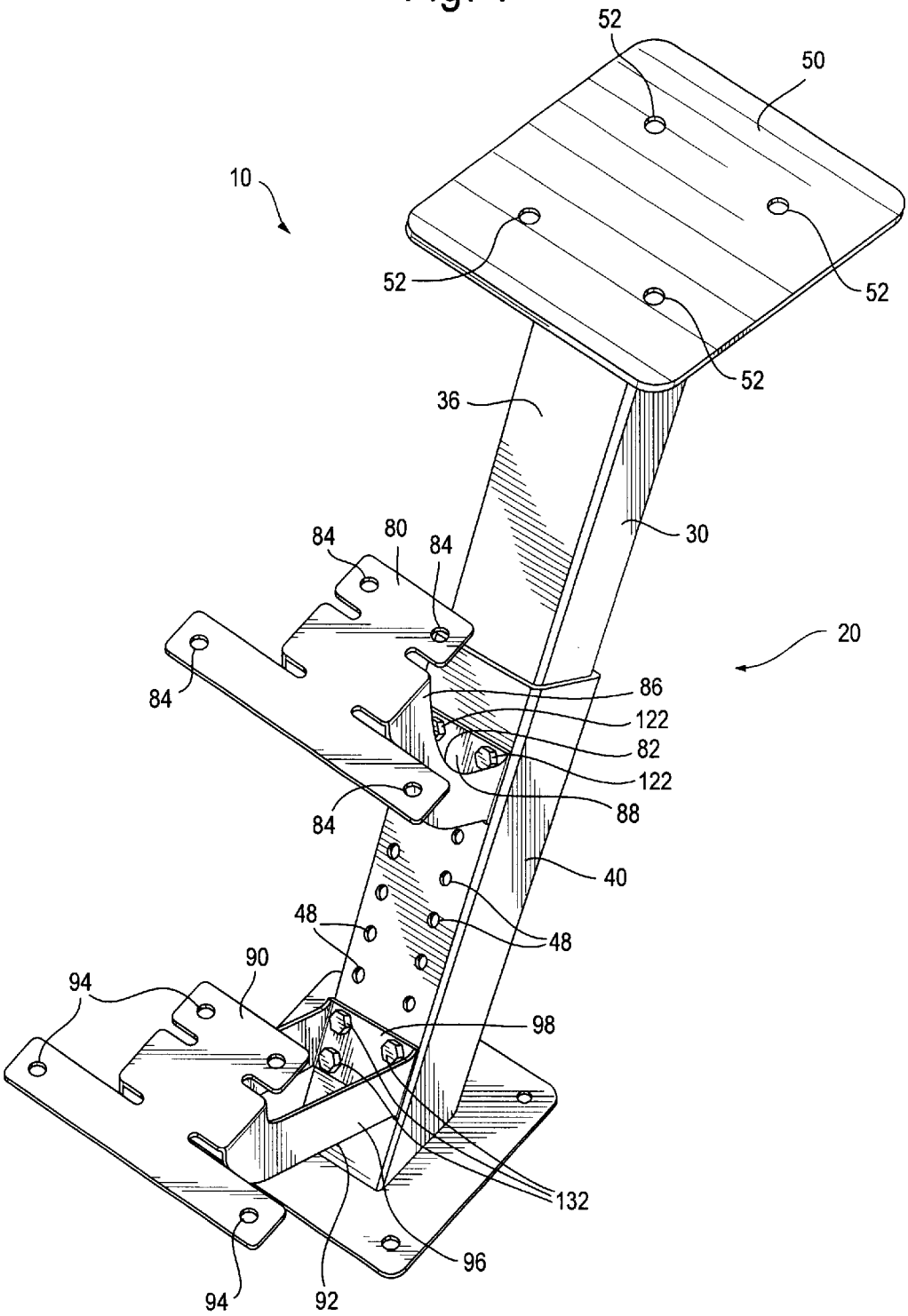
FIG. 1 is a perspective view illustrating an adjustable pedestal embodying this invention, as taken from a back, side vantage.
Figure 2:
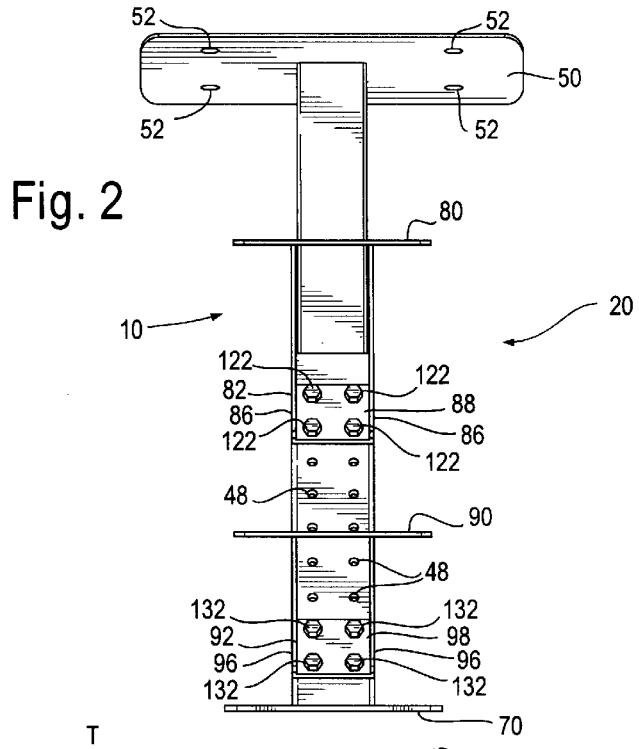
FIG. 2 is a back view of the pedestal.

As illustrated in FIG. 1, the step 80 has four unthreaded holes 84 and the step 90 has four unthreaded holes 94. As illustrated in FIG. 1, each step 80, 90, is provided with a step cover C, which may be polymeric and which is mounted to said step 80, 90, via stainless steel fasteners $F_C$, which are conventional fasteners having threaded shanks extending upwardly through the holes 84, 94, in said step 80, 90, into conventional, suitably threaded, downwardly opening receptacles (not shown) embedded in said step 80, 90. As illustrated in FIG. 1 and FIG. 2, the bracket 82 has two lateral arms 86, to the distal ends of which the step 80 is welded, and a bight 88, which connects the proximal ends of the lateral arms 86, and the bracket 92 has two lateral arms 96, to the distal ends of which the step 90 is welded, and a bight 98, which connects the proximal ends of the lateral arms 96. As illustrated in FIG. 4, the bight 88 of the bracket 82 has four unthreaded holes 102 and the bight 98 of the bracket 90 has four unthreaded holes 112.

When the pedestal 10 is provided with two steps or with a single step, four conventional bolts 122 are used to mount the step 80, via the bracket 82, and to fasten the respective members 20, 30, to each other so as to provide the generally upright column 20 with an overall length adjusted for a given installation of the pedestal 10. Each bolt 122 has a threaded shank, which is passed through one of the unthreaded holes 102 of the bight 88 of the bracket 80, through one of the unthreaded holes 48 of the back wall 46 of the lower member 40, and through one of the unthreaded holes 38 of the upper member 30, and which is threaded into one of the threaded holes 62 of the fastening plate 60. When the pedestal 10 is provided with two steps, four conventional bolts 132 are used to mount the step 90, via the bracket 92. Each bolt 132 has a threaded shank, which is passed through one of the unthreaded holes 112 of the bight 98 of the bracket 90 and through one of the lowermost two holes 48 in each column of unthreaded holes 48 of the back wall 46 of the lower member 40, and which is threaded into one of the threaded holes 62 of the fastening plate 60.

What is claimed is:

1. For a starting platform for one end of a swimming pool, an adjustable pedestal for supporting a top for the starting platform, wherein the adjustable pedestal has an upper plate, an upper member, and a lower member, the upper plate being mounted on the upper member, wherein the upper and lower members are fastened releasably to each other so as to define a generally upright column having any of a plurality of adjustable lengths, the upper member being adapted to support a top for the starting platform and the lower member being adapted for anchoring to a base, and wherein the pedestal further has a step, which is fastened releasably to the generally upright column, below the plate and via a bracket, to which the step is mounted, at any of a plurality of vertically adjustable positions.

2. The pedestal of claim 1 having means comprising a bolt or bolts for fastening the upper and lower members of the generally upright column releasably to each other and for fastening the bracket, to which the step is mounted, releasably to the generally upright column.

3. The pedestal of claim 1 wherein the step is one of two steps, which are comprised of an upper step and a lower step, wherein the bracket is one of two brackets, which are comprised of an upper bracket and a lower bracket, the upper step being mounted to the upper bracket and the lower step being mounted to the lower bracket, wherein the upper step is fastened releasably to the generally upright column, via the upper bracket, at any of a plurality of adjustable positions, and wherein the lower step is fastened releasably to the generally upright column, via the lower bracket, at any of a plurality of adjustable positions.

4. The pedestal of claim 3 having means comprising bolts for fastening the upper and lower members of the generally upright column releasably to each other, for fastening the upper bracket, to which the upper step is mounted, releasably to the generally upright column, and for fastening the lower bracket, to which the lower step is mounted to the generally upright column.

5. The pedestal of claim 4 wherein the means for fastening the upper and lower members of the generally upright column to each other are used for fastening the upper bracket, to which the upper step is mounted, releasably to the generally upright column.

6. The pedestal of any one of claims 1, 2, 3, 4, and 5 wherein the upper and lower members of the generally upright column have a telescoping relationship when not fastened to each other.

7. The pedestal of claim 6 wherein both of the upper and lower members are tubular.

8. The pedestal of claim 6 wherein the upper member extends downwardly into the lower member.

9. The pedestal of claim 7 wherein the upper member extends downwardly into the lower member.

* * * * *